US008620650B2

(12) United States Patent
Walters et al.

(10) Patent No.: US 8,620,650 B2
(45) Date of Patent: Dec. 31, 2013

(54) REJECTING NOISE WITH PAIRED MICROPHONES

(75) Inventors: Luke C. Walters, Miami, FL (US); Vasu Iyengar, Shrewsbury, MA (US); Martin David Ring, Ashland, MA (US)

(73) Assignee: Bose Corporation, Framingham, MA (US)

( * ) Notice: Subject to any disclaimer, the term of this patent is extended or adjusted under 35 U.S.C. 154(b) by 432 days.

(21) Appl. No.: 13/078,632

(22) Filed: Apr. 1, 2011

(65) Prior Publication Data

US 2012/0253798 A1 Oct. 4, 2012

(51) Int. Cl.
*G10L 21/00* (2013.01)

(52) U.S. Cl.
USPC ..... 704/226; 704/233; 704/214; 231/98

(58) Field of Classification Search
USPC ..... 704/226, 233, 214; 391/98; 381/98
See application file for complete search history.

(56) References Cited

U.S. PATENT DOCUMENTS

2006/0262946 A1 11/2006 Yang
2009/0125303 A1* 5/2009 Tachibana ..... 704/226
2009/0147966 A1 6/2009 McIntosh et al.
2009/0209290 A1 8/2009 Chen et al.
2010/0046776 A1 2/2010 Fischer et al.
2010/0128901 A1* 5/2010 Herman ..... 381/98
2010/0142716 A1* 6/2010 Lee et al. ..... 381/57
2010/0280824 A1* 11/2010 Petit et al. ..... 704/214

FOREIGN PATENT DOCUMENTS

JP 3106299 A 5/1991
WO 2008/099200 A1 8/2008

OTHER PUBLICATIONS

Wikipedia Microphone article, retrieved from the Internet Archive, entry dated Dec. 24, 2010.*
International Search Report and the Written Opinion of the International Searching Authority dated Jul. 3, 2012 for PCT/US2012/030685.
International Search Report and Written Opinion dated Jun. 6, 2012 for PCT/US2012/030686.

* cited by examiner

*Primary Examiner* — Vincent P Harper

(57) ABSTRACT

A system for combining signals includes a first microphone generating a first input signal having a first voice component and a first noise component, a second microphone generating a second input signal having a second voice component and a second noise component, a mixing circuit, and an adaptive filter. The mixing circuit applies a first gain having a value α to the first input signal to produce a first scaled signal, applies a second gain having a value 1−α to the second input signal to produce a second scaled signal, and sums the first scaled signal and the second scaled signal to produce a summed signal. The adaptive filter computes an updated value of α to minimize the energy of the summed signal based on the summed signal, the first input signal and the second input signal, and provides the updated value of α to the mixing circuit.

33 Claims, 3 Drawing Sheets

REJECTING NOISE WITH PAIRED MICROPHONES

BACKGROUND

This disclosure relates to using paired microphones to reject noise.

A headset for communicating through a telecommunication system, whether wired or wireless, will generally include a microphone for detecting the voice of the wearer. Such microphones are exposed to several types of noise, including ambient noise from the environment, such as other people talking, and wind noise caused by air moving past the microphone.

FIG. 1 shows an in-ear headset 10 commercially available from Bose Corporation in Framingham, Mass. The headset 10 includes an electronics module 12, an acoustic driver module 14, and an ear interface 16 that fits into the wearer's ear to retain the headset and couple the acoustic output of the driver module 14 to the user's ear canal. In the example headset of FIG. 1, the ear interface 16 includes an extension 18 that fits into the upper part of the wearer's ear to help retain the headset. The headset may be wireless, that is, there may be no wire or cable that mechanically or electronically couples the earpiece to any other device. This headset is shown only for reference. The ideas disclosed below are applicable to any device having a microphone to be used in a potentially noisy environment.

SUMMARY

In general, in one aspect, a system for combining signals includes a first microphone generating a first input signal having a first voice component and a first noise component, a second microphone generating a second input signal having a second voice component and a second noise component, a mixing circuit, and an adaptive filter. The mixing circuit applies a first gain having a value $\alpha$ do the first input signal to produce a first scaled signal, applies a second gain having a value $1-\alpha$ to the second input signal to produce a second scaled signal, and sums the first scaled signal and the second scaled signal to produce a summed signal. The adaptive filter computes an updated value of $\alpha$ to minimize the energy of the summed signal based on the summed signal, the first input signal and the second input signal, and provides the updated value of $\alpha$ to the mixing circuit.

Implementations may include one or more of the following. The first noise component may have a greater contribution from ambient noise than from wind noise. The first microphone may include a pressure microphone. The second noise component may have a greater contribution from wind noise than from ambient noise. The first microphone may be more sensitive to ambient noise than to wind noise. The second microphone may be more sensitive to wind noise than to ambient noise. The second microphone may include a gradient microphone. The first microphone may include a pressure microphone, the second microphone may include a gradient microphone, and the first and second microphones may be located at a common location within the system.

The adaptive filter may be configured to apply a least-mean-squared algorithm to compute the updated value of $\alpha$. The adaptive filter may be implemented in a digital signal processor programmed to compute a difference between the first and second signals, multiply the summed signal by the difference and by a pre-determined step size value, and subtract the product from the current value of $\alpha$ to produce the updated value of $\alpha$. The adaptive filter may be implemented in a digital signal processor programmed to decompose the summed signal and the first and second input signals into frequency bands and to minimize the energy of the summed signal in a first energy band. The mixing circuit may apply the first and second gains by applying different values of $\alpha$ and $1-\alpha$, respectively, in different frequency bands.

An equalizer may receive at least one of the first input signal or second input signal and equalize the received signal according to a pre-defined equalization curve to match the first voice component to the second voice component. The equalizer may include a first equalizer to apply a first equalization curve to the first input signal to produce a first equalized signal, and a second equalizer to apply a second equalization curve to the second input signal to produce a second equalized signal, the first and second equalized signals having matching voice components. The equalizer may include a single equalizer configured to apply an equalization curve to the first input signal to produce a first equalized signal, the first equalized signal having an equalized voice component matching the second voice component from the second input signal. A low-pass filter may filter the second input signal before the second input signal is provided to the adaptive filter. A second equalizer may be coupled to the output of the mixing circuit to optimize a voice response of the summed signal for use in a communications system.

The mixing circuit may be further configured to apply a gain to at least one of the first input signal or the second input signal before providing the first and second input signals to the adaptive filter. Either or both of the mixing circuit and the adaptive filter may be implemented in a digital signal processor. The mixing circuit may include a first voltage-controlled amplifier configured to apply the first gain, and a second voltage-controlled amplifier configured to apply the second gain, the outputs of the first and second voltage-controlled amplifiers being coupled to produce the summed signal.

In general, in one aspect, a device includes a windscreen in a first surface, a gradient microphone housed in a capsule having first and second outlets coupled to openings in a second surface displaced from the first surface, a pressure microphone mounted between the first and second surfaces, and circuitry coupled to the gradient microphone and the pressure microphone and operable to combine the signals of the microphones and provide a combined microphone signal.

Implementations may include one or more of the following. The first surface and the second surface may be displaced a non-zero distance from each other. The first surface, the second surface, and at least one wall between the first surface and the second surface enclose a volume, and the openings in the second surface and a sensing element of the pressure microphone may both be coupled to the volume. The pressure microphone may be mounted in the wall between the first surface and the second surface.

Advantages include rejecting noise in various environments, seamlessly combining signals from different microphones each best-suited for the noise found in different environments.

Other features and advantages will be apparent from the description and the claims.

DESCRIPTION

Figure 1:
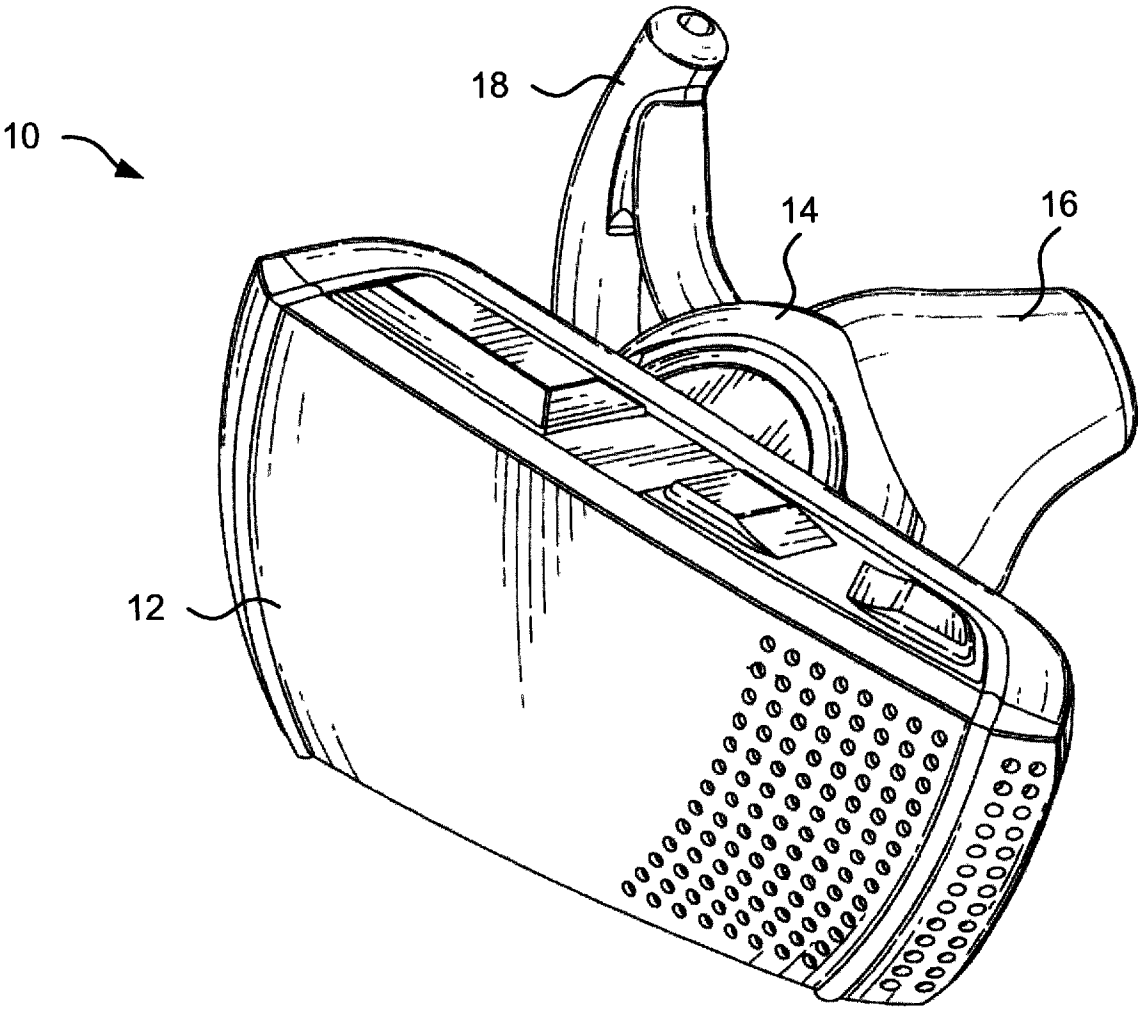
FIG. 1 shows a wireless headset.
Figure 2:
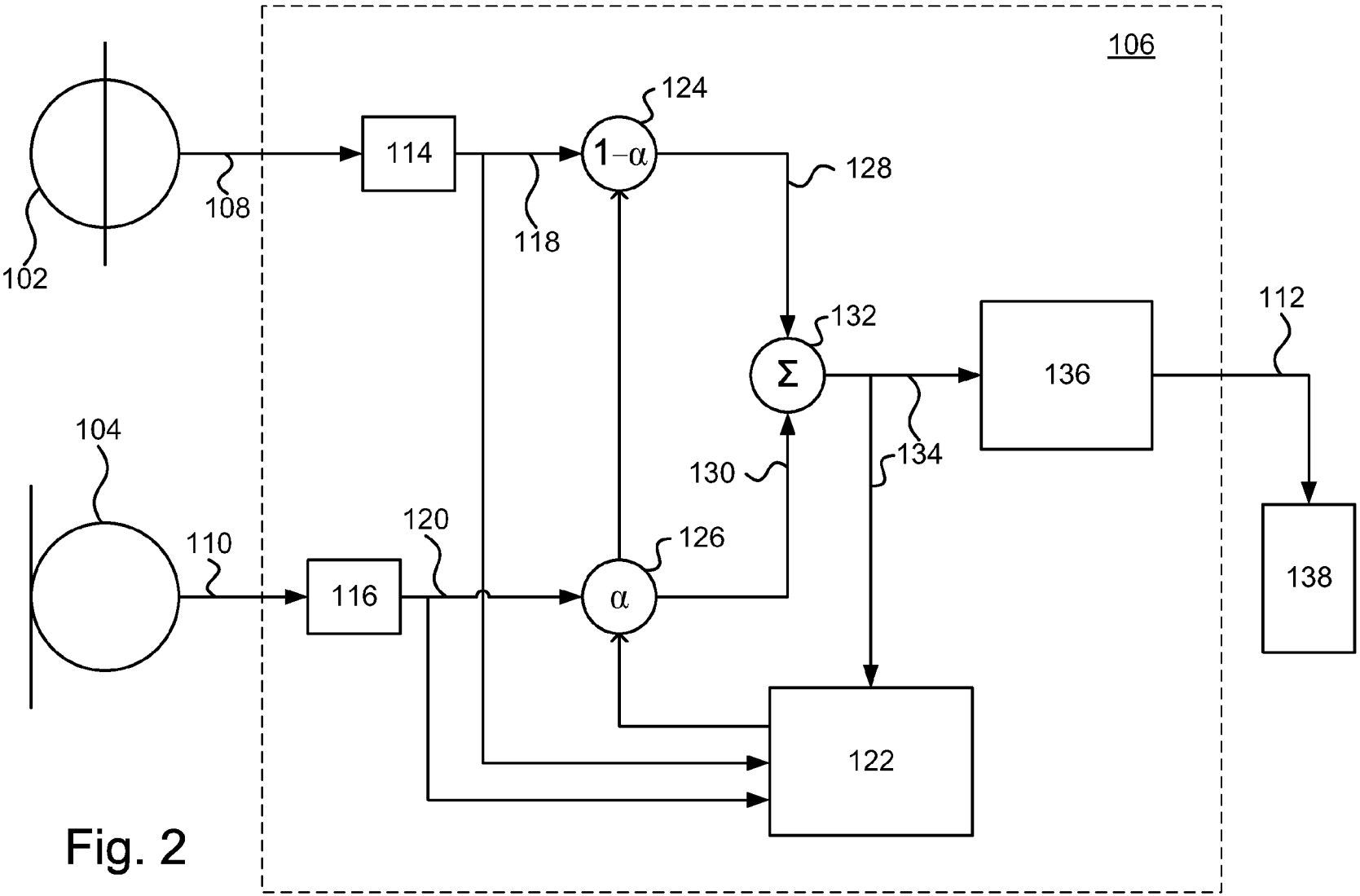
FIG. 2 shows a block diagram of a microphone signal mixing circuit.

A commercial embodiment of the Bluetooth headset shown in FIG. 1 uses a single microphone encapsulated in a two-port physical structure behind a screen to reduce noise in far-end voice communications, as described in co-pending application Ser. No. 13/075,732, which is incorporated here by reference. The physical structure decreases the amount of noise detected by the microphone, reducing noise in the sounds heard by the far end communication partner. Adding a second microphone and mixing the electrical signals from the two microphones as shown in FIG. 2 offers further improvements in noise rejection. In particular, the encapsulated microphone 102 offers good rejection of ambient noise (e.g., other people talking nearby, traffic, machinery), but it tends to pick up noise from wind, i.e., the noise of air moving past the headset. The second microphone 104 is selected to provide good rejection of wind noise, even if that means it is more likely to pick up ambient noises. The mixing circuit 106 combines the signals 108, 110 from the two microphones to produce an output signal 112 that has a strong voice component and little noise.

We represent the microphone signal 108 from the first microphone 102 as having a value $W=V_w+N_w$, where $V_w$ is the voice component and $N_w$ is the noise component, which is influenced more by wind noise than it is by ambient noise. Similarly, we represent the microphone signal 110 from the second microphone 104 as having a value $D=V_d+N_d$, where $V_d$ is the voice component and $N_d$ is the noise component, which for this microphone is influenced more by ambient noise than it is by wind noise. In this particular example, the noise component $N_w$ is influenced more by wind noise than by ambient noise, and the noise component $N_d$ is influenced more by ambient noise than by wind noise, but the mixing circuit 106 is generally applicable to any system for combining two inputs with different responses to noise. The mixing circuit 106 first equalizes one or both of the microphone signals. Equalizers 114 and 116 apply an equalization curve to the respective microphone signals 108 and 110 to produce equalized signals 118, 120, which we represent as $W_e=V_{we}+N_{we}$ and $D_e=V_{de}+N_{de}$. The equalization curves applied by the equalizers 114 and 116 are designed to match the microphones' voice responses, independently of what their noise response might be, so that $V_{we}=V_{de}$. In some examples, only one equalizer is used, matching the corresponding microphone signal to the unequalized voice response of the other microphone signal, e.g., $V_{we}=V_d$ or $V_{de}=V_w$. The equalization can be carried out in a digital signal processor (DSP), a microprocessor, or by analog components, such as an R-L-C network.

The equalized signals are then scaled, one by a scaling factor $\alpha$ and the other by $1-\alpha$, in scaling blocks 124 and 126, to produce scaled signals 128 and 130 with values $(1-\alpha)(V_{we}+N_{we})$ and $\alpha(V_{de}+N_{de})$. The scaled signals 128 and 130 are then summed by a summer 132. The summed signal 134, with value $Y=(1-\alpha)(V_{we}+N_{we})+\alpha(V_{de}+N_{de})$, is passed on to a voice equalizer 136 that equalizes the summed signal to produce the appropriate voice response for use by subsequent communications circuitry 138. We refer to the scaling and summing of the signals as "mixing." As with the equalization, the mixing can be carried out in a DSP or a microprocessor programmed to multiply the signals by the scaling factors and add the results. Alternatively, the mixing may be done in analog components, such as a pair of voltage-controlled amplifiers with their outputs coupled to produce the summed signal.

The microphone signals and the summed signal are also provided to an adaptive filter 122, which outputs the scaling factor $\alpha$. The filter 122 may use either the unequalized signals 108 and 110 or the equalized signals 118 and 120. In some examples, it is advantageous to use the equalized signals so that the voice components are already matched. The scaling factor $\alpha$ is computed to provide that whichever of the microphone signals has less noise will provide a greater contribution to the summed signal 134. In some examples, $\alpha$ varies between zero and one. Other values may also be used, including a narrower range (e.g., to assure at least some signal is used from each microphone), a wider range (e.g., to allow one signal to over-drive the summed signal), or a discrete set of values rather than a continuously variable value.

The summed signal 134 will have a voice component of $\alpha V_{de}-\alpha V_{we}+V_{we}$, and a noise component of $\alpha N_{de}-\alpha N_{we}+N_{we}$. Because the equalization earlier provided that $V_{we}=V_{de}$, the total voice component is equal to $V_{we}$, which is independent of the value of $\alpha$. Because only the noise component is affected by the scaling factor $\alpha$, the value of $\alpha$ can be selected to minimize the noise, whatever its source, without affecting the voice signal. In a DSP implementation, the adaptive filter output $\alpha$ is provided as data to control the gains of the scaling stages; in an analog implementation, the filter output may be a voltage to control voltage controlled amplifiers. Other implementations are also possible.

In some examples, the adaptive filter 122 applies an algorithm that selects $\alpha$ by treating the summed signal 134 as an error input and setting the output $\alpha$ to minimize the total energy of the summed "error" signal. As the summed signal has a constant voice component, minimizing the total energy will result in the filter decreasing the contribution of whichever microphone signal is contributing more noise to the total. When there is little ambient noise or wind noise at the same time, the adaptive algorithm may cause $\alpha$ to vary continuous because neither microphone contributes significant noise to the total. This may be undesirable. To address that, the filter may be biased in favor of whichever microphone has a better overall quality in situations having high signal to noise ratios. Additional noise removing algorithms may be applied in the subsequent circuitry 138.

The adaptive filter 122 used to determine the mixing coefficient $\alpha$ may be implemented in many different ways. In one example, a least-mean-squared adaptive filter is used to minimize the total energy in the mixed signal. This has the advantage of being relatively simple and cost-effective to implement. Building on the signal representations noted above, the total mixed signal Y at a given time t is:

$$Y_t=\alpha D_t+(1-\alpha)W_t=\alpha(D_t-W_t)+W_t \tag{1}$$

where $W_t$ and $D_t$ are the total equalized microphone signals 118 and 120 at time t. The LMS filter works to minimize the energy of the total mixed "error" signal Y, $$\min_\alpha E\{|Y|^2\}=\min_\alpha E\{(\alpha(D_t-W_t)+W_t)^2\}. \tag{2}$$

The cost function in (2) is a quadratic in $\alpha$ and has a single optimal solution that varies with changing noise environments. A steepest-descent algorithm using a small step size parameter $\mu$ can be used in the adaptive filter, with the updated $\alpha$ found as:

$$\alpha_{t+1} = a_t - \frac{1}{2}\mu\frac{dE\{|Y|^2\}}{d\alpha}. \quad (3)$$

From (1) and (2), the derivative in (3) is found as a function of the summed output Y and the difference between the input microphone signals D and W:

$$\frac{dE\{|Y|^2\}}{d\alpha} = E\left\{\underbrace{2(\alpha(D_t - W_t) + W_t)}_{Y_t}(D_t - W_t)\right\} = 2E\{Y_t(D_t - W_t)\}. \quad (3)$$

For a short-time adaptive solution, the instantaneous estimate of the derivative is used in place of the expectation to provide the LMS filter output:

$$\alpha_{t+1}=\alpha_t-\mu Y_t(D_t-W_t), \quad (4)$$

which can be normalized as:

$$\alpha_{t+1} = a_t - \mu Y_t\frac{(D_t - W_t)}{|D_t - W_t|^2}. \quad (5)$$

In another example, a multi-tap adaptive filter may be used to provide for frequency-dependent blending of the signals. Similarly, a frequency-domain analysis may be performed, again with different values of α produced for different frequency bands. Using frequency-dependent blending may allow optimization of the voice component with improved filtering of noise that is outside the voice band, or more generally, allow optimal blending of inputs with different response characteristics. As with the other components, the filter may be implemented using analog circuitry or a DSP, or other suitable circuitry, such as a programmed microprocessor. In some examples, it is possible to power a system implemented with low-power analog electronics entirely by the microphone bias power supply. The order of steps may also be varied, for example, the overall voice response equalization may be performed as part of the microphone-matching equalization, optimizing the microphones for the later voice processing independently of each other.

In some examples, an additional low-pass filter is applied to the wind-sensitive microphone signal 118 when it is input to the adaptive filter 122 to band-limit the signal to frequencies where the wind noise is dominant. This has the effect of biasing the filter in favor of the wind-sensitive microphone when the wind is not present, which is preferred in cases where the wind-sensitive microphone has a better overall signal to noise ratio with regard to voice.

In some examples, scaling factors may be added to bias one or the other microphone signal by a few dB to compensate for expected drift in the microphone responses. In addition, one or both microphone signals may have a gain applied to adjust a given unit for the specific sensitivities of its microphones, which tend to have significant part-to-part variability. This is advantageous as it helps to assure that the two microphones' voice responses are matched.

The two microphones 102 and 104 are represented in FIG. 2 as a gradient microphone and a pressure microphone to differentiate them, but the mixing carried out by the circuit 106 is generally applicable to combining signals from any two systems that provide different responses to noise. For the microphone 102 with less sensitivity to ambient noise, examples may include a velocity microphone or a higher-order differential microphone array. For the microphone 104 with less sensitivity to wind noise, other examples may include a delay and sum beamformer, which may have more ambient noise suppression than a pressure microphone alone while still being less sensitive to wind than a gradient microphone. One particular embodiment for use in the headset shown in FIG. 1 is described below.

In one example, the first microphone 102 is a gradient microphone located inside a two-port capsule. By gradient microphone, we mean an electroacoustic transducer that is responsive to the pressure gradient between two points. Gradient microphones tend to have bidirectional microphone patterns, which is useful in providing a good voice response in a wireless headset, where the microphone can be pointed in the general direction of the user's mouth. Such a microphone provides a good response in ambient noise, but is susceptible to wind noise. The second microphone 104 is a pressure microphone, which tends to have an omnidirectional microphone pattern. By pressure microphone, we mean an electroacoustic transducer that is responsive to the pressure in the air to which it is exposed, and which produces an electrical signal representative of that pressure. A single pressure microphone may provide a good response in wind noise, especially if a proper wind screen is used, but will provide little rejection of ambient noise. In some examples, a pair of pressure microphones is used together as a gradient microphone for the first microphone signal (the difference between the signals from the pressure microphones representing the gradient between them), and in that case, one of the same pressure microphones may be used on its own as a pressure microphone for the second microphone signal, or a third microphone may be used.

Figure 3:
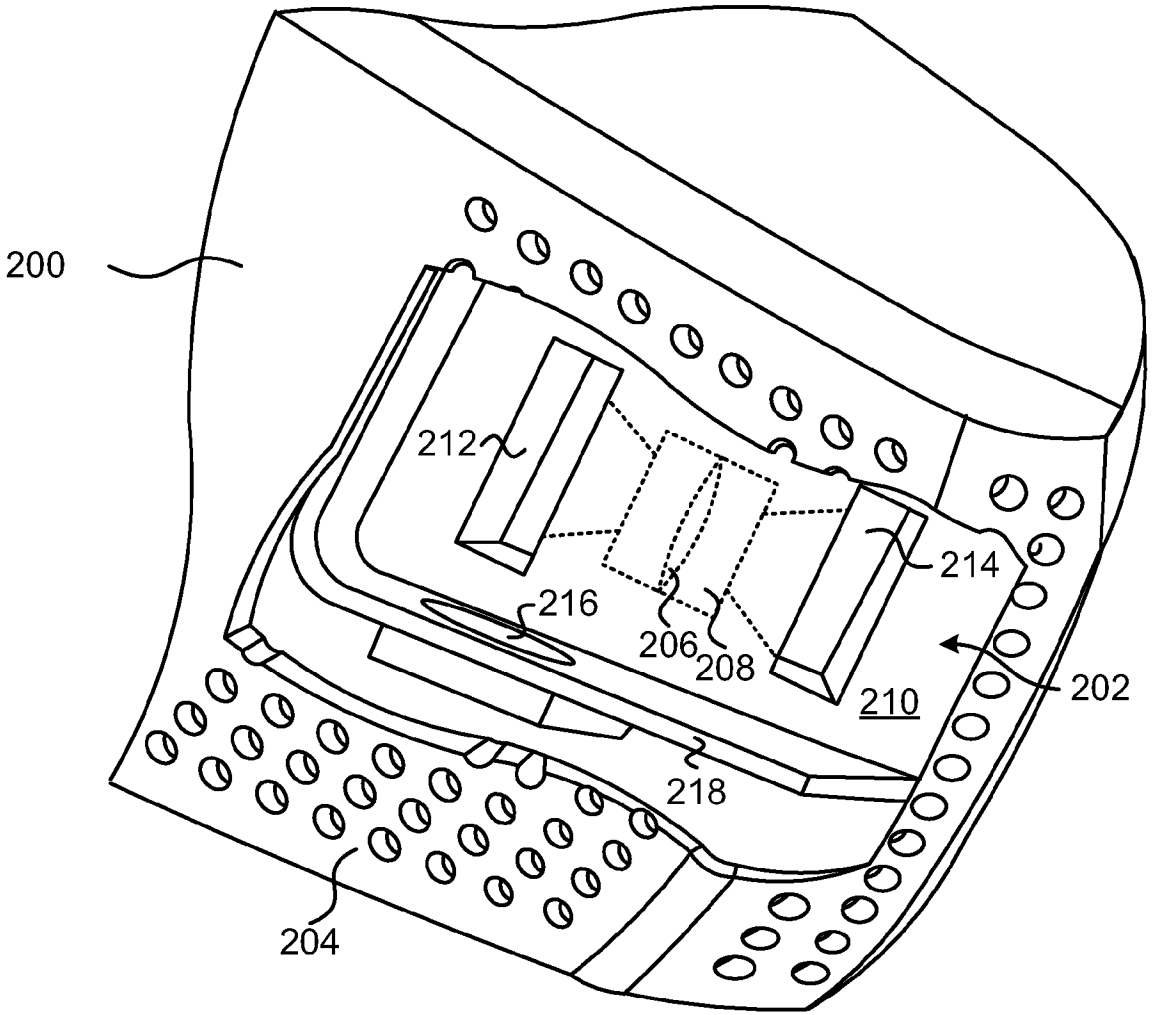
FIG. 3 shows a cutaway view of a microphone housing in a wireless headset.

One embodiment using a gradient microphone and a pressure microphone is shown in FIG. 3. In this example, a wireless headset 200 has a recessed shelf 202 at the front to accommodate both microphones. The shelf 202 is covered by a screen 204 in the outer shell of the headset, shown partially cut away to reveal the shelf. The screen may extend beyond the limits of the shelf for cosmetic reasons. A gradient microphone 206 is located in a capsule 208 under the surface 210 of the recessed shelf. Two ports 212 and 214 connect the two sides of the gradient microphone 206 to the volume of air within the shelf. The pressure microphone 216 is located on a side wall 218 of the recessed shelf 202. Both microphones are connected to circuitry elsewhere in the headset (not shown).

Placing the microphones under a windscreen advantageously eliminates some wind noise from both microphones. In one example, a windscreen reduced the signal due to wind noise at the pressure microphone by about 8 dB and at the gradient microphone by about 16 dB, relative to having no windscreen at all, allowing the signal mixing circuit to have less noise to remove in the first place. The position of the shelf below the windscreen also provides an air volume and linear distance between the windscreen and the microphones, which further decrease the amount of wind noise at the microphones. In particular, to be most effective, the windscreen should have a greater total surface area than the faces of the microphones (in the area of the screen that is actually exposed to the microphones—the cosmetic portions don't have any effect). Without the shelf, only the part of the screen directly over the microphones would matter, and would be effectively the same area as the microphones, decreasing its effectiveness. The resistance of the windscreen can also be selected to control the frequency at which the response of the gradient microphone rolls off. In one example, a resistance of 15 Rayls causes the gradient microphone to roll off below about 100 Hz. Higher or lower values may be used in a given embodiment based on the inherent wind sensitivity and roll-off frequency of the microphones used.

The microphone layout described here is not limited to headsets, but may also be useful in other communications devices that may be used in noisy environments, such as a portable speaker phone or conferencing system, for example. One or more gradient microphones may be used to pick up the voices of the people around the phone, while an omni-directional microphone with better wind noise rejection is used to capture the same voices when wind compromises the performance of one or more of the gradient microphones.

Other implementations are within the scope of the following claims and other claims to which the applicant may be entitled.

What is claimed is:

1. An apparatus for combining signals comprising:

a first microphone generating a first input signal having a first voice component and a first noise component;

a second microphone generating a second input signal having a second voice component and a second noise component;

a mixing circuit configured to:

apply a first gain having a value $\alpha$ to the first input signal to produce a first scaled signal;

apply a second gain having a value $1-\alpha$ to the second input signal to produce a second scaled signal; and sum the first scaled signal and the second scaled signal to produce a summed signal; and an adaptive filter configured to compute an updated value of $\alpha$ to minimize the energy of the summed signal based on the summed signal, the first input signal and the second input signal, and to provide the updated value of $\alpha$ to the mixing circuit, wherein the adaptive filter is configured to apply a least-mean-squared algorithm to compute the updated value of $\alpha$, and the adaptive filter is implemented in a digital signal processor programmed to compute a difference between the first and second signals, multiply the summed signal by the difference and by a pre-determined step size value, and subtract the product from the current value of $\alpha$ to produce the updated value of $\alpha$.

2. The apparatus of claim 1 wherein the first noise component has a greater contribution from ambient noise than from wind noise.

3. The apparatus of claim 1 wherein the first microphone comprises a pressure microphone.

4. The apparatus of claim 1 wherein the second noise component has a greater contribution from wind noise than from ambient noise.

5. The apparatus of claim 1 wherein the second microphone comprises a gradient microphone.

6. The apparatus of claim 1 wherein the first microphone comprises a pressure microphone, the second microphone comprises a gradient microphone, and the first and second microphones are located at a common location within the apparatus.

7. The apparatus of claim 1 wherein the adaptive filter is implemented in a digital signal processor programmed to decompose the summed signal and the first and second input signals into frequency bands and to minimize the energy of the summed signal in a first energy band.

8. The method of claim 1 wherein the mixing circuit applies the first and second gains by applying different values of $\alpha$ and $1-\alpha$, respectively, in different frequency bands.

9. The apparatus of claim 1 further comprising:

an equalizer receiving at least one of the first input signal or second input signal and configured to equalize the received signal according to a pre-defined equalization curve to match the first voice component to the second voice component.

10. The apparatus of claim 1 further comprising a low-pass filter configured to filter the second input signal before the second input signal is provided to the adaptive filter.

11. The apparatus of claim 1 wherein the mixing circuit is further configured to apply a gain to at least one of the first input signal or the second input signal before providing the first and second input signals to the adaptive filter.

12. The apparatus of claim 1 wherein at least the mixing circuit and the adaptive filter are implemented in a digital signal processor.

13. The apparatus of claim 1 wherein the mixing circuit comprises:

a first voltage-controlled amplifier configured to apply the first gain, and a second voltage-controlled amplifier configured to apply the second gain, wherein the outputs of the first and second voltage-controlled amplifiers are coupled to produce the summed signal.

14. An apparatus for combining signals comprising:

a first microphone generating a first input signal having a first voice component and a first noise component;

a second microphone generating a second input signal having a second voice component and a second noise component;

a mixing circuit configured to:

apply a first gain having a value $\alpha$ to the first input signal to produce a first scaled signal;

apply a second gain having a value $1-\alpha$ to the second input signal to produce a second scaled signal; and sum the first scaled signal and the second scaled signal to produce a summed signal;

an adaptive filter configured to compute an updated value of $\alpha$ to minimize the energy of the summed signal based on the summed signal, the first input signal and the second input signal, and to provide the updated value of $\alpha$ to the mixing circuit;

a first equalizer configured to apply a first equalization curve to the first input signal to produce a first equalized signal, and a second equalizer configured to apply a second equalization curve to the second input signal to produce a second equalized signal, the first and second equalized signals having matching voice components.

15. The apparatus of claim 14 wherein the adaptive filter is configured to apply a least-mean-squared algorithm to compute the updated value of $\alpha$.

16. The apparatus of claim 15 wherein the adaptive filter is implemented in a digital signal processor programmed to compute a difference between the first and second signals, multiply the summed signal by the difference and by a pre-determined step size value, and subtract the product from the current value of $\alpha$ to produce the updated value of $\alpha$.

17. An apparatus for combining signals comprising:

a first microphone generating a first input signal having a first voice component and a first noise component;

a second microphone generating a second input signal having a second voice component and a second noise component;

a mixing circuit configured to:

apply a first gain having a value $\alpha$ to the first input signal to produce a first scaled signal;

apply a second gain having a value $1-\alpha$ to the second input signal to produce a second scaled signal; and sum the first scaled signal and the second scaled signal to produce a summed signal;

an adaptive filter configured to compute an updated value of $\alpha$ to minimize the energy of the summed signal based on the summed signal, the first input signal and the second input signal, and to provide the updated value of $\alpha$ to the mixing circuit; and a single equalizer configured to apply an equalization curve to the first input signal to produce a first equalized signal, the first equalized signal having an equalized voice component matching the second voice component from the second input signal.

18. The apparatus of claim 17 further comprising a second equalizer coupled to the output of the mixing circuit and configured to optimize a voice response of the summed signal for use in a communications system.

19. A method of combining signals comprising:

receiving a first input signal from a first microphone, the first input signal having a first voice component representing the response of the first microphone to voice, and a first noise component representing the response of the first microphone to noise;

receiving a second input signal from a second microphone, the second input signal having a second voice component representing the voice response of the second microphone, and a second noise component representing the response of the second microphone to noise;

applying a first gain having a value $\alpha$ to the first input signal to produce a first scaled signal;

applying a second gain having a value $1-\alpha$ to the second input signal to produce a second scaled signal;

summing the first scaled signal and the second scaled signal to produce a summed signal;

in an adaptive filter, computing an updated value of $\alpha$ to minimize the energy of the summed signal based on the summed signal, the first input signal, and the second input signal;

updating the values of the first and second gains based on the updated value of $\alpha$; and outputting the summed signal based on the updated value of $\alpha$;

wherein computing the updated value of $\alpha$ comprises applying a least-mean-squared algorithm by, in a digital signal processor:

computing a difference between the first and second signals, multiplying the summed signal by the difference and by a pre-determined step size value, and subtracting the product from the current value of $\alpha$ to produce the updated value of $\alpha$.

20. The method of claim 19 wherein the first microphone is more sensitive to ambient noise than to wind noise.

21. The method of claim 19 wherein the first microphone comprises a pressure microphone.

22. The method of claim 19 wherein the second microphone is more sensitive to wind noise than to ambient noise.

23. The method of claim 19 wherein the second microphone comprises a gradient microphone.

24. The method of claim 19 wherein computing the updated value of $\alpha$ comprises decomposing the summed signal and the first and second input signals into frequency bands and minimizing the energy of the summed signal in a first energy band.

25. The method of claim 19 wherein applying the first and second gains comprises applying different values of $\alpha$ and $1-\alpha$, respectively, in different frequency bands.

26. The method of claim 19 further comprising equalizing at least one of the first input signal or the second input signal according to a pre-defined equalization curve to match the first voice component to the second voice component.

27. The method of claim 19 further comprising equalizing the summed signal to optimize a voice response of the summed signal for use in a communications system.

28. The method of claim 19 further comprising low-pass filtering the second input signal before providing the second input signal to the adaptive filter.

29. The method of claim 19 further comprising applying a gain to at least one of the first input signal or the second input signal before providing the first and second input signals to the adaptive filter.

30. A method of combining signals comprising:

receiving a first input signal from a first microphone, the first input signal having a first voice component representing the response of the first microphone to voice, and a first noise component representing the response of the first microphone to noise;

receiving a second input signal from a second microphone, the second input signal having a second voice component representing the voice response of the second microphone, and a second noise component representing the response of the second microphone to noise;

applying a first gain having a value $\alpha$ to the first input signal to produce a first scaled signal;

applying a second gain having a value $1-\alpha$ to the second input signal to produce a second scaled signal;

summing the first scaled signal and the second scaled signal to produce a summed signal;

in an adaptive filter, computing an updated value of $\alpha$ to minimize the energy of the summed signal based on the summed signal, the first input signal, and the second input signal;

updating the values of the first and second gains based on the updated value of $\alpha$; and outputting the summed signal based on the updated value of $\alpha$;

applying a first equalization curve to the first input signal to produce a first equalized signal; and applying a second equalization curve to the second input signal to produce a second equalized signal, the first and second equalized signals having matching voice components.

31. The method of claim 30 wherein computing the updated value of $\alpha$ comprises applying a least-mean-squared algorithm.

32. The method of claim 31 wherein applying the least-mean-squared algorithm comprises, in a digital signal processor:

computing a difference between the first and second signals, multiplying the summed signal by the difference and by a pre-determined step size value, and subtracting the product from the current value of $\alpha$ to produce the updated value of $\alpha$.

33. A method of combining signals comprising:

receiving a first input signal from a first microphone, the first input signal having a first voice component representing the response of the first microphone to voice, and a first noise component representing the response of the first microphone to noise;

receiving a second input signal from a second microphone, the second input signal having a second voice component representing the voice response of the second microphone, and a second noise component representing the response of the second microphone to noise;

applying a first gain having a value $\alpha$ to the first input signal to produce a first scaled signal;

applying a second gain having a value $1-\alpha$ to the second input signal to produce a second scaled signal;

summing the first scaled signal and the second scaled signal to produce a summed signal;

in an adaptive filter, computing an updated value of $\alpha$ to minimize the energy of the summed signal based on the summed signal, the first input signal, and the second input signal;

updating the values of the first and second gains based on the updated value of $\alpha$; and outputting the summed signal based on the updated value of $\alpha$; and applying a first equalization curve to the first input signal to produce a first equalized signal, the first equalized signal having an equalized voice component matching the second voice component from the second input signal.

* * * * *